US010156216B2

(12) United States Patent
Tanada et al.

(10) Patent No.: US 10,156,216 B2
(45) Date of Patent: Dec. 18, 2018

(54) INJECTOR

(71) Applicant: DENSO CORPORATION, Kariya, Aichi-pref. (JP)

(72) Inventors: Hiroki Tanada, Kariya (JP); Daiji Ueda, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/738,692

(22) PCT Filed: Jun. 2, 2016

(86) PCT No.: PCT/JP2016/002678

§ 371 (c)(1),
(2) Date: Dec. 21, 2017

(87) PCT Pub. No.: WO2016/208130

PCT Pub. Date: Dec. 29, 2016

(65) Prior Publication Data

US 2018/0195476 A1 Jul. 12, 2018

(30) Foreign Application Priority Data

Jun. 26, 2015 (JP) ..... 2015-129333
Sep. 15, 2015 (JP) ..... 2015-182219

(51) Int. Cl.
*F02M 47/02* (2006.01)
*F02M 47/00* (2006.01)
*F02M 55/00* (2006.01)

(52) U.S. Cl.
CPC ..... *F02M 47/02* (2013.01); *F02M 47/00* (2013.01); *F02M 47/027* (2013.01); *F02M 55/008* (2013.01); *F02M 2547/008* (2013.01)

(58) Field of Classification Search
CPC ..... F02M 47/00; F02M 47/02; F02M 55/008; F02M 47/027; F02M 2547/008
See application file for complete search history.

(56) References Cited

U.S. PATENT DOCUMENTS

2006/0283424 A1* 12/2006 Nagatomo ..... F02M 45/086 123/467
2010/0251999 A1* 10/2010 Kondo ..... F02M 47/027 123/470

(Continued)

FOREIGN PATENT DOCUMENTS

JP 2011-12670 1/2011
JP 2014-98323 5/2014

*Primary Examiner* — Sizo Vilakazi
(74) *Attorney, Agent, or Firm* — Nixon & Vanderhye P.C.

(57) ABSTRACT

An enclosure member includes a throughhole that penetrates a cover portion. The cover portion includes a blocking portion that receives an abutment by a wall portion to close an opening of an outflow passage with respect to spaces outside of the enclosure member. The blocking portion is provided so as to surround an opening of the throughhole, and the throughhole is in communication with the outflow passage even when the blocking portion is abutting the wall portion. Further, a spring is outside of a back pressure chamber to bias the enclosure member. The enclosure member itself blocks outside spaces from the back pressure chamber, so the expenditure of high pressure fuel may be controlled, and an injection hole may be opened and closed by a needle.

6 Claims, 8 Drawing Sheets

(56) References Cited

U.S. PATENT DOCUMENTS

| | | | | |
|---|---|---|---|---|
| 2010/0301143 | A1 | 12/2010 | Adachi et al. | |
| 2010/0313850 | A1* | 12/2010 | Kondo | F02M 47/027 123/445 |
| 2011/0006130 | A1* | 1/2011 | Kondo | F02M 47/027 239/71 |
| 2012/0042852 | A1* | 2/2012 | Yamada | F02M 47/027 123/445 |
| 2013/0221256 | A1* | 8/2013 | Tsuru | F02M 63/008 251/129.15 |
| 2014/0131483 | A1 | 5/2014 | Adachi | |
| 2018/0195476 | A1* | 7/2018 | Tanada | F02M 47/00 |

* cited by examiner

INJECTOR

This application is the U.S. national phase of Internal Application No. PCT/JP2016/002678, filed Jun. 2, 2016, which designated the U.S. and claims priority to Japanese patent application No. 2015-129333 filed on Jun. 26, 2015, and Japanese patent application No. 2015-182219 filed on Sep. 15, 2015, the contents of each of which are incorporated herein by reference.

CROSS-REFERENCE TO RELATED APPLICATIONS

The present application is based on Japanese patent application No. 2015-129333 filed on Jun. 26, 2015, and Japanese patent application No. 2015-182219 filed on Sep. 15, 2015, the content of which is incorporated herein by reference.

TECHNICAL FIELD

The present disclosure relates to an injector that injects fuel.

BACKGROUND

Conventionally, it is well known that an injector may include a needle, a body, a back pressure chamber, an inflow passage, an outflow passage, and a drive unit, as will be explained. The needle is a valve body which opens and closes an injection hole that injects fuel. The body is cylindrical and houses the needle therein. Further, the body includes the injection hole. The back pressure chamber is provided for exerting a fuel back pressure in the direction of closing the injection hole. The inflow passage is provided to allow fuel to flow into the back pressure chamber, such that high pressure fuel from a supply pump is always allowed to flow from the inflow passage into the back pressure chamber. The outflow passage is provided to allow fuel to flow out from the back pressure chamber. The drive unit opens or closes the outflow passage based on a control signal from a controller, and thereby increases or decreases the back pressure to control the opening and closing of the injection hole via the needle.

However, according to such an injector, when the outflow passage is opened, a connection between the inflow passage and the outflow passage is maintained and high pressure fuel is continuously expended. As a result, the load on the supply pump may be significant. Further, a large amount of force may be necessary to close the outflow passage, and thus the physical size of the drive unit may need to be large as well.

In this regard, regarding the injector, it is known that a moveable plate may be disposed within the back pressure chamber in a floating state (for example, refer to Patent Literature 1). According to the configuration of Patent Literature 1, when the outflow passage is opened, the movable plate is moved due to a pressure difference, and the opening to the inflow passage is closed. For this reason, when the outflow passage is opened, a connection between the inflow passage and the outflow passage is blocked. As a result, high pressure fuel is not expended and the load on the supply pump may be reduced. Further, a large amount of power may not be needed to close the outflow passage, and so the physical size of the drive unit may be reduced.

With the configuration of Patent Literature 1, the movable plate is driven in a floating manner, and so there is a concern that the orientation of the movable plate may be unstable during operation due to being easily affected by fuel flow or gravity.

To deal with this, it is known that the movable plate may be biased by a spring (for example, refer to Patent Literature 2). According to the configuration of Patent Literature 2, a spring is disposed in the back pressure chamber, and by biasing the movable plate, the movable plate may be operated in a stable manner.

However, according to the configuration of Patent Literature 2, the capacity of the back pressure chamber must be increased by an amount corresponding to the installation part of the spring, and if the capacity of the back pressure chamber is increased, the following concerns arise. Specifically, the portions of the injector closer toward the leading side than a seat portion of the needle are not exposed to high pressure fuel when closed. Then, when opened, the portions closer to the leading side than the seat portion are suddenly exposed to high pressure fuel, and the needle may receive a force in the axial direction.

It is known that due to receiving this force, the valve body may shake and adversely affect fuel injection controls. It is further known that the magnitude of this shaking is proportional to the capacity of the back pressure chamber.

PRIOR ART LITERATURES

Patent Literatures

Patent Literature 1: JP-2014-98323-A
Patent Literature 2: JP-2011-12670-A

SUMMARY OF INVENTION

An object of the present disclosure is to provide an injector capable of mitigating the shaking of a needle when opening an injection hole.

According to the present disclosure, an injector includes a needle, a body, a back pressure chamber, an outflow passage, a drive unit, an enclosure member, a spring, and a wall portion. The needle is a valve body configured to open and close an injection hole that injects fuel. The body has a cylindrical shape and houses the needle therein, the body having the injection hole. The back pressure chamber is provided to exert a back pressure of fuel on the needle in a direction of closing the injection hole. The outflow passage allows fuel to flow out of the back pressure chamber.

The drive unit is configured to open and close the outflow passage based on a control signal from a controller, thereby increasing or decreasing the back pressure to operate the opening and closing of the injection hole via the needle. The enclosure member that includes a cover portion configured to cover a rear end of the needle from a rear side, and a cylinder portion configured to be in slidable contact with an outer circumferential surface of the needle to slidably support the needle, the rear end of the needle being surrounded by the cover portion and the cylinder portion to form the back pressure chamber on a rear end side of the needle.

The spring is configured to bias the enclosure member toward the rear side. The wall portion is disposed on the rear side of the cover portion and is configured to receive an abutment of the cover portion to regulate movement of the enclosure member toward the rear side, the wall portion including an opening of the outflow passage.

Here, the enclosure member includes at least one through-hole that penetrates through the cover portion. Further, the cover portion includes a blocking portion that, when the cover portion abuts the wall portion, blocks the opening of the outflow passage with respect to spaces outside of the enclosure member. Further, the blocking portion is provided so as to surround an opening of the throughhole, the throughhole being in communication with the outflow passage even when abutting the cover portion. Further, the spring is outside of the back pressure chamber to bias the enclosure member.

Due to this, by filling the spaces outside of the enclosure member with high pressure fuel, the injection hole may be opened and closed through the needle.

In other words, when the when the drive unit opens the outflow passage, a fuel flow from the back pressure chamber toward the outflow passage is generated. As a result, the enclosure member is strongly biased toward the rear side by a pressure difference in the fuel flow as well as the biasing force of the spring, and the opening of the outflow passage is firmly closed by the blocking portion. For this reason, while the outside of the enclosure member is blocked from the outflow passage and the back pressure chamber, communication between the outflow passage and the back pressure chamber may be maintained. As a result, consumption of high pressure fuel may be suppressed, and as the back pressure reduces, the needle may be separated from the body to open the injection hole.

Further, when the drive unit closes the outflow passage, the flow of fuel from the back pressure chamber toward the outflow passage is stopped.

As a result, the enclosure member is biased by outside fuel pressure, and temporarily compresses the spring to move toward the leading side. For this reason, the back pressure chamber is temporarily opened with respect to the outside of the enclosure member, and high pressure fuel flows into the back pressure chamber. As a result, the back pressure is increased, and the needle seats on the body to close the injection hole.

As described above, according to the injector of the present disclosure, the enclosure member itself opens and closes a path between outside spaces and the back pressure chamber. Thus, consumption of high pressure fuel may be suppressed, and at the same time, the injection hole may be opened and closed by operating the back pressure, i.e., the needle. Further, due to the operation of the enclosure member in this manner, the spring may be disposed outside of the back pressure chamber as well.

Accordingly, by disposing the spring outside of the back pressure chamber, the capacity of the back pressure chamber may be reduced, and it is possible to mitigate shaking of the needle caused by opening of the injection hole.

Further, according to the present disclosure, an injector includes a needle, a body, a back pressure chamber, an outflow passage, a drive unit, an enclosure member, a spring, and a wall portion. The needle is a valve body configured to open and close an injection hole that injects fuel. The body has a cylindrical shape and houses the needle therein, the body having the injection hole. The back pressure chamber is provided to exert a back pressure of fuel on the needle in a direction of closing the injection hole. The outflow passage allows fuel to flow out of the back pressure chamber.

The drive unit is configured to increase or decrease the back pressure based on a control signal from a controller to operate the opening and closing of the injection hole via the needle. Here, the drive unit includes a three way valve that switches the outflow passage between two connections, the outflow passage being connected to one connection when the back pressure is to be decreased, the outflow passage being connect to another connection when the back pressure is to be increased.

The enclosure member includes a cover portion configured to cover a rear end of the needle from a rear side, and a cylinder portion configured to be in slidable contact with an outer circumferential surface of the needle to slidably support the needle, the rear end of the needle being surrounded by the cover portion and the cylinder portion to form the back pressure chamber on a rear end side of the needle. The spring is configured to bias the enclosure member toward the rear side. The wall portion is disposed on the rear side of the cover portion and configured to receive an abutment of the cover portion to regulate movement of the enclosure member toward the rear side, the wall portion including an opening of the outflow passage.

Here, the enclosure member includes at least one throughhole that penetrates through the cover portion. Further, the cover portion includes a blocking portion that, when the cover portion abuts the wall portion, blocks the opening of the outflow passage with respect to spaces outside of the enclosure member. Further, the blocking portion is provided so as to surround an opening of the throughhole, the throughhole being in communication with the outflow passage even when abutting the cover portion. Further, the spring is outside of the back pressure chamber to bias the enclosure member.

Due to this, by filling the spaces outside of the enclosure member with high pressure fuel, and switching the connection of the outflow passage between a high pressure passage and a low pressure passage, the injection hole may be opened and closed through the needle.

In other words, when the drive unit connects the outflow passage to the low pressure passage, a fuel flow from the back pressure chamber toward the outflow passage is generated. As a result, the enclosure member is strongly biased toward the rear side by a pressure difference in the fuel flow as well as the biasing force of the spring, and the opening of the outflow passage is firmly closed by the blocking portion. For this reason, while the outside of the enclosure member is blocked from the outflow passage and the back pressure chamber, communication between the outflow passage and the back pressure chamber may be maintained. As a result, consumption of high pressure fuel may be suppressed, and as the back pressure reduces, the needle may be separated from the body to open the injection hole.

Further, when the drive unit switches the connection of the outflow passage to the high pressure passage, the enclosure member is biased by outside fuel pressure acting on itself as well as fuel pressure guided from the high pressure passage into the outflow passage, and temporarily compresses the spring to move toward the leading side. For this reason, the back pressure chamber is temporarily opened with respect to the outside of the enclosure member, and high pressure fuel flows into the back pressure chamber. As a result, the back pressure is increased, and the needle may be seated on the body to close the injection hole.

At this time, since the enclosure member is biased by both fuel pressure acting on the outer surfaces of itself as well as fuel pressure guided from the high pressure passage into the outflow passage, the enclosure member may be moved toward the leading side faster. Accordingly, the flow of fuel into the back pressure chamber may be started at an earlier timing, and the injection hole may be closed faster.

EMBODIMENTS FOR CARRYING OUT INVENTION

Hereinafter, embodiments for implementing the present disclosure will be explained. Further, the following embodiments are specific examples, and the present disclosure is not intended to be limited to these embodiments.

(First Embodiment)

Figure 1:
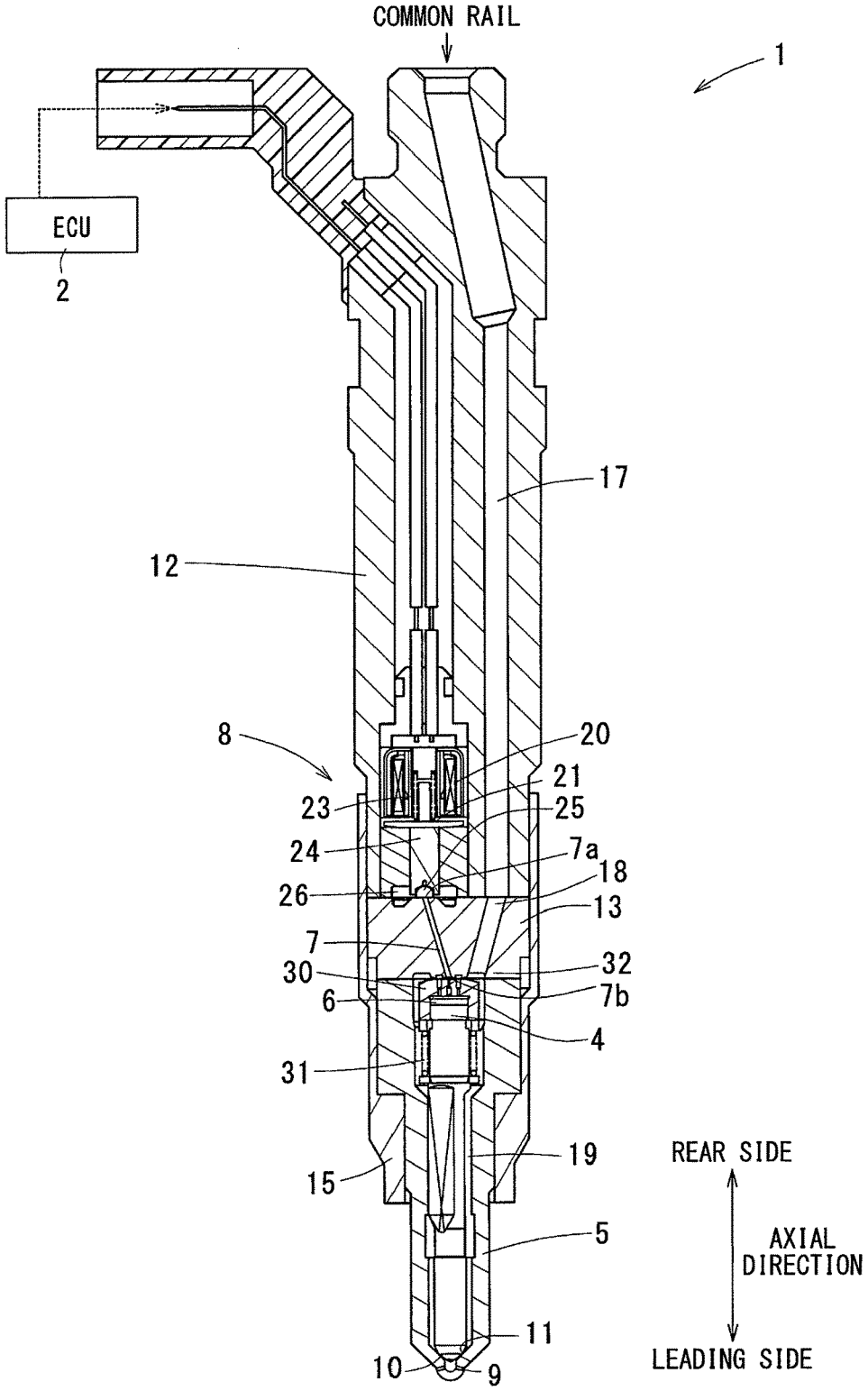
FIG. 1 is a cross section view of an entirety of an injector.

The structure of an injector 1 according to a first embodiment will be explained with reference to FIG. 1.

The injector 1 is one component of a fuel supply device, along with a supply pump (not illustrated), a common rail (not illustrated), and an ECU 2. The supply pump pressurizes fuel, and high pressure fuel from the supply pump is temporarily stored in the common rail. Then, the high pressure fuel from the common rail is distributed and supplied to the injector.

The ECU 2 calculates an injection amount based on parameters such as the load of an internal combustion engine, the rotation speed of the internal combustion engine, etc. The ECU 2 also calculates an injection start time and an injection period corresponding to the injection amount, depending on the rail pressure of the common rail supplying the injector 1

The injector 1 is mounted in the internal combustion engine (not illustrated). For example, the injector 1 may be used for direct injection of high pressure fuel (e.g., over 250 MPa) into a cylinder. The injector 1 includes a needle 4, a body 5, a back pressure chamber 6, an outflow passage 7, and a drive unit 8, as will be explained below. In the following explanation, a leading side in the axial direction and a rear side in the axial direction may be referred to as a leading side and a rear side for simplicity.

The needle 4 has a cylindrical shape, and is a valve body that opens and closes an injection hole 9 which injects fuel. A seat portion 10 is disposed at the leading end portion of the needle 4. The seat portion 10 performs the opening and closing of the injection hole 9.

The body 5 has a cylindrical shape, and slidably houses the needle 4 therein. The injection hole 9 is formed on a leading end portion of the body 5. Further, a seat surface 11 is formed on an inner wall of the body 5. The seat portion 10 is configured to seat on and separate from the seat surface 11. Accordingly, when the seat portion 10 is separated from the seat surface 11, the injection hole 9 is opened and fuel is injected. Further, when the seat portion 10 is seated on the seat surface 11, the injection hole 9 is closed and fuel injection is stopped.

The back pressure chamber 6 is defined by a rear end surface of the needle 4, and is provided to exert a fuel back pressure on the needle 4 in a direction of closing the injection hole 9. The outflow passage 7 allows fuel to flow out from the back pressure chamber 6. The details of the back pressure chamber 6 and the outflow passage 7 will be described later.

The drive unit 8 opens and closes the outflow passage 7 based on a control signal sent from the ECU 2. By opening and closing the outflow passage 7, the drive unit 8 increases or decreases the back pressure to control the opening and closing of the injection hole 9 via the needle 4.

The drive unit 8 is housed within a retention body 12. A metal plate 13 is interposed between the retention body 12 and the body 5. The metal plate 13 is fastened by a retaining nut 15. Further, high pressure passages 17, 18, 19 are formed in the retention body 12, the plate 13, and the body 5, respectively. The high pressure passages 17, 18, 19 guide high pressure fuel supplied from the common rail to the injection hole 9.

In addition, the outflow passage 7 is formed in the plate 13. The outflow passage 7 penetrates through the plate 13 in an axial direction. In addition, the outflow passage 7 opens at an opening 7*a* on the rear end surface of the plate 13, and opens at an opening 7*b* on the leading end surface of the plate 13. The drive unit 8 may be an electromagnetic solenoid including a coil 20, an armature 21, and a return spring 23. A sliding shaft 24 moves integrally with the armature 21. A valve body 25 is housed in the leading end of the sliding shaft 24.

The drive unit 8 attracts the armature 21 toward the rear side when the coil 20 is energized, thereby causing the valve body 25 to move toward the rear side. Then, the opening 7*a* is opened, and the outflow passage 7 is communicated with a low pressure passage 26.

Conversely, when the energization of the coil 20 is stopped, the drive unit 8 causes the armature 21 to move toward the leading side due to the return spring 23. Then, the valve body 25 is moved toward the leading side to close the opening 7*a*. Further, in the first embodiment, while an electromagnetic solenoid is used as the drive unit 8, a piezo actuator which using an piezo element that expands in the axial direction may be used instead.

(Characteristics of First Embodiment)

Figure 2:
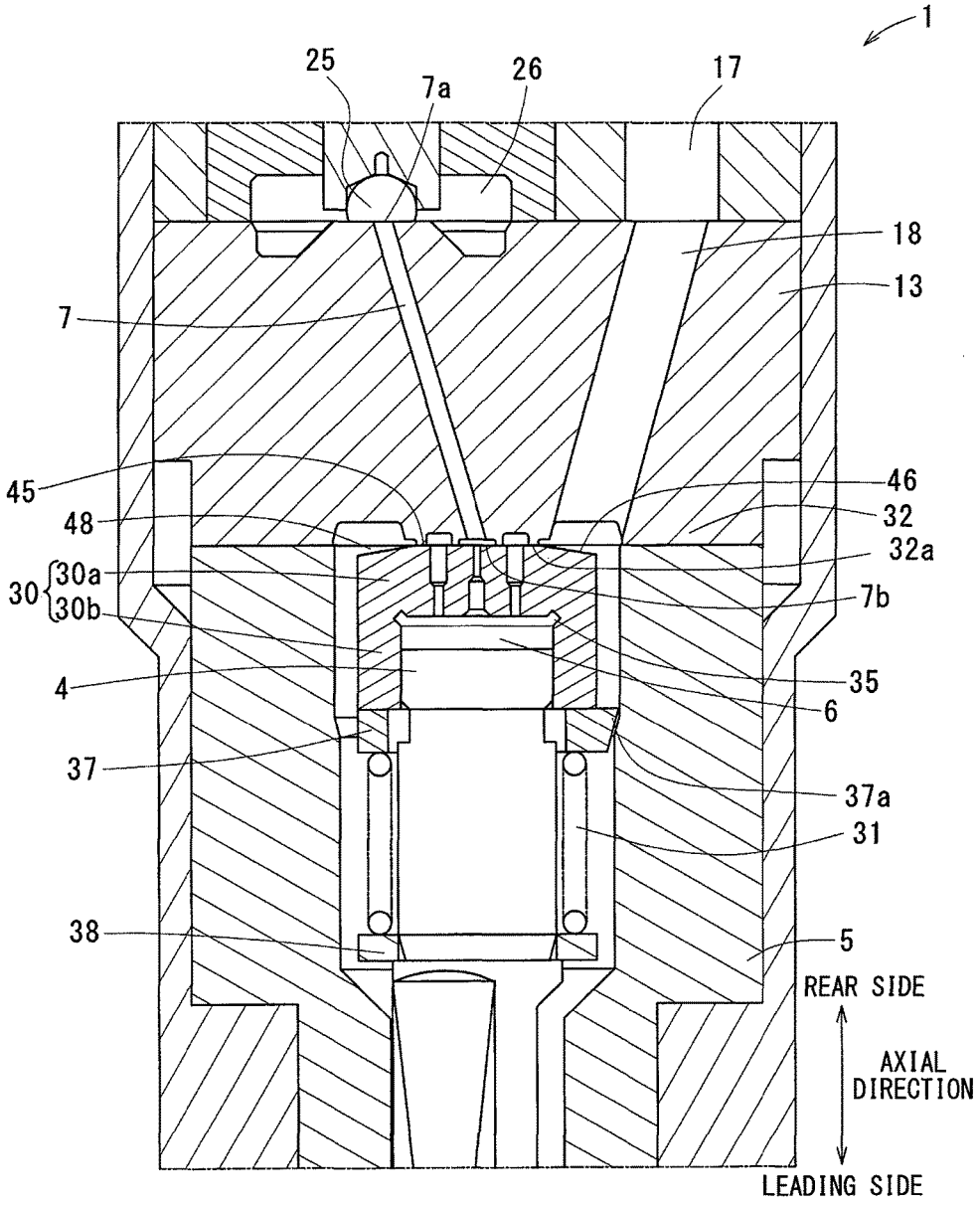
FIG. 2 is a cross section view of a main section of an injector.
Figure 3:
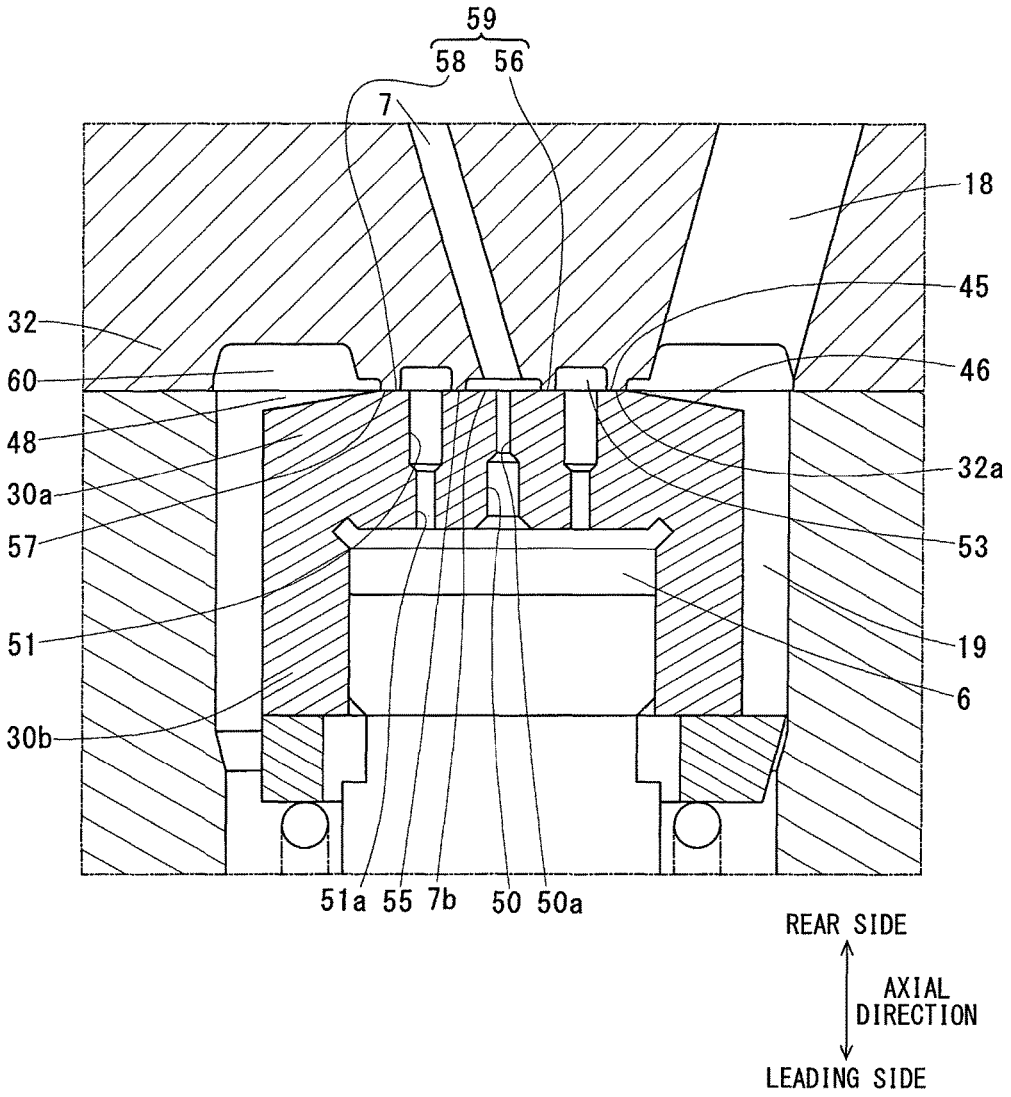
FIG. 3 is a cross section view of an enclosure member.

Characteristics of the first embodiment will be explained with reference to FIGS. 1, 2, and 3.

The injector 1 includes an enclosure member 30, a spring 31, and a wall portion 32 as will be explained below. The enclosure member 30 is disposed on the leading end side of the plate 13. Further, the enclosure member 30 includes a cover portion 30*a* and a cylinder portion 30*b*. The cover portion 30*a* and the cylinder portion 30*b* are integrally formed together. The cover portion 30*a* covers the rear end of the needle 4 from the rear side. The cylinder portion 30*b* is in sliding contact with the outer circumferential surface of the needle 4, and therefore is in sliding contact with the needle 4.

Further, the enclosure member 30 is fitted onto the rear end of the needle 4 such that the rear end of the needle 4 is surrounded by the cover portion 30*a* and the cylinder portion 30*b*, thereby forming the back pressure chamber 6. Here, a recess processed portion 35 is provided on an outer circumferential portion of the inner circumferential rear end surface of the enclosure member 30. The recess processed portion 35 is formed as a recessed groove on the outer circumferential side and the rear end side.

Due to this, a polishing process device may be inserted into the inside of the rear end side of the back pressure chamber 6. Accordingly, a polishing process of the inner circumferential surface of the cylinder portion 30*b* may be performed until the inside of the rear end side, and so the sliding contact characteristics of the needle 4 may be improved.

The spring 31 is disposed outside of the back pressure chamber 6. The spring 31 biases the enclosure member 30 toward the rear side through a stopper 37. Further, the stopper 37 is an annular member, and is fixed to the front end of the enclosure member 30. A joint portion 37*a* of the stopper 37 protrudes out in the outer circumferential direction and is joined to the inner wall of the body 5 to regulate movement toward the leading side. Further, since the movement of the stopper 37 is regulated, the movement of the enclosure member 30 is also regulated.

Further, the spring 31 is also set so as to bias the needle 4 toward the leading side through a spring seat 38. The needle 4 is moved toward the lead side by the biasing force of the spring 31 as well as the back pressure to close the injection hole 9.

In other words, the spring 31 is set so as to bias the enclosure member 30 toward the rear side while also biasing the needle 4 toward the leading side. The wall portion 32 is part of the leading end of the plate 13, and abuts the cover portion 30*a* to regulate movement of the enclosure member 30 toward the rear side. Further, the opening 7*b* opens at a leading end surface 32*a* of the wall portion 32.

The cover portion 30*a* includes a flat surface portion 45 which abuts the leading end surface 32*a*, and a tapered surface portion 46 arranged on the outer circumferential edge of the flat surface portion 45. The tapered surface portion 46 is configured so that even when the flat surface portion 45 is abutting the leading end surface 32*a*, a gap 48 is formed between the leading end surface 32*a* and the tapered surface portion 46. Further, the size of the gap 48 between the tapered surface portion 46 and the leading end surface 32*a* in the axial direction increases toward the outer circumferential side.

Further, an abrasion resistance treatment is performed on each of the flat surface portion 45 and the leading end surface 32*a*. Such an abrasion resistance treatment may be, for example, a DLC coating on the surfaces, hard chrome plating, etc.

Details of the enclosure member 30 will be explained with reference to FIG. 3.

An inflow/outflow hole 50 is formed as an axial direction throughhole at a center portion of the cover portion 30*a*. Further, as another axial direction throughhole, inflow holes 51 are formed. Specifically, two inflow holes 51 are formed, and are disposed spaced away from the inflow/outflow hole 50 at locations equidistant in the radial direction and centered about the inflow/outflow hole 50.

Further, as will be explained in detail later, the inflow/outflow hole 50 is configured as a passage that allows fuel to flow into and out of the back pressure chamber 6. Further, the inflow holes 51 are configured as passages which allow fuel to flow into the back pressure chamber 6. Here, the inflow/outflow hole 50 and the inflow holes 51 all open at the flat surface portion 45. Further, an annular groove 53 is formed on the wall portion 32 so as to surround the opening 7*b*. When the cover portion 30*a* is abutting the wall portion 32, the openings of the two inflow holes 51 face into the annular groove 53.

Further, choke sections 50*a*, 51*a* are provided in the inflow/outflow hole 50 and the inflow holes 51, respectively. The choke section 50*a* is a rear side portion of the inflow/outflow hole 50 where the passage cross section area is reduced. Each choke section 51*a* is a leading side portion of the inflow holes 51 where the passage cross section area is reduced.

Further, when the cover portion 30*a* is abutting the wall portion 32, an annular flat surface portion 55 abuts an annular flat surface portion 56. Here, the annular flat surface portion 55 is a part of the leading end surface 32*a*, and is formed in an annular shape between the opening 7*b* and the annular groove 53. Further, the annular flat surface portion 56 is a portion of the flat surface portion 45, and is formed so as to surround the inflow/outflow hole 50.

Here, when the annular flat surface portion 55 is abutting the annular flat surface portion 56 as well, the inflow/outflow hole 50 faces the opening 7*b* and is in communication with the outflow passage 7.

Then, when the cover portion 30*a* is abutting the wall portion 32, the annular flat surface portion 55 abuts the annular flat surface portion 56 as well, and an annular flat surface portion 57 abuts an annular flat surface portion 58 to close the opening 7*b* with respect to spaces outside of the enclosure member 30. Here, the annular flat surface portion 57 is formed so as to surround the annular groove 53 of the wall portion 32. Further, the annular flat surface portion 58 is formed in an annular shape so as to surround the three openings of the inflow/outflow hole 50 and the inflow holes 51 formed on the flat surface portion 45.

In other words, when the cover portion 30*a* is abutting the wall portion 32, the annular flat surface portion 56 and the annular flat surface portion 58 form a blocking portion 59 that closes the opening 7*b* with respect to spaces outside of the enclosure member 30. Further, an annular groove 60 is formed on the outer circumference of the annular flat surface portion 57 of the wall portion 32 so as to encompass the tapered surface portion 46.

A space formed by the gap 48 and the annular groove 60 is a part of the high pressure passages 18, 19, and a space on the outer circumferential side of the cylinder portion 30*b* is a part of the high pressure passage 19, and these spaces are defined as spaces outside of the enclosure member 30. Further, each of these spaces is configured to be filled with high pressure fuel.

(Operation of First Embodiment)

The operation of the injector 1 will be explained with reference to FIGS. 1 to 4.

The coil 20 is energized based on a control signal from the ECU 2, and as a result, the valve body 25 opens the outflow passage 7 with respect to the low pressure passage 26. Fuel begins to flow out from the outflow passage 7, and pressure in the outflow passage 7 decreases. The enclosure member 30 is biased in advance by the spring 31 toward the rear side so as to abut the wall portion 32. Then, due to a pressure difference between the back pressure chamber 6 and the outflow passage 7 generated by the choke section 50*a*, the enclosure member 30 is further biased toward the rear side.

Figure 4A:
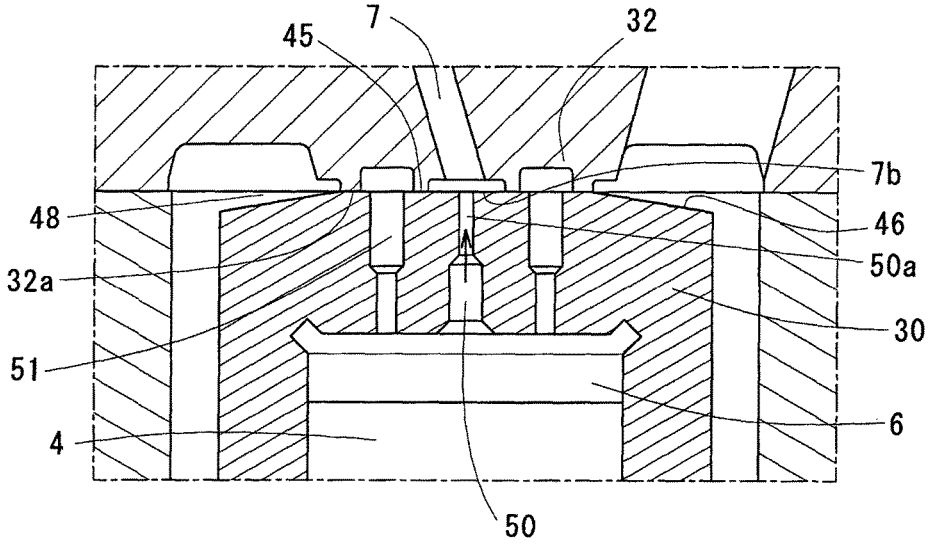
FIG. 4A is an operational view of an enclosure member.

Due to the above, the enclosure member 30 blocks communication between the gap 48 and the back pressure chamber 6 as well as the opening 7*b* (see FIG. 4A).

The fuel in the back pressure chamber 6 passes through the inflow/outflow hole 50 of the enclosure member 30 (see arrow in FIG. 4A) and flows out through the outflow passage 7 into the low pressure passage 26.

Accordingly, the pressure in the back pressure chamber 6 decreases. Thus, the force received by the leading end portion of the needle 4 exceeds the biasing force of the spring 31 and the back pressure. As a result, the needle 4 is pushed up toward the rear side, and begins to displace.

Then, the seat portion 10 of the needle 4 separates from the seat surface 11 of the body 5, and as a result, the injection hole 9 is opened. Further, the force received by the leading end portion of the needle 4 prior to the seat separation is the force received by the portions of the needle 4 which are circumferentially outward of the seat portion 10.

When the energization of the coil 20 is stopped based on a control signal from the ECU 2, the valve body 25 closes the outflow passage 7. When the outflow passage 7 is closed, the communication between the outflow passage 7 and the low pressure passage 26 is blocked, and fuel stops flowing out from the outflow passage 7. Due to this, the pressure difference between the back pressure chamber 6 and the outflow passage 7 decreases, and the biasing force toward the rear side decreases. Accordingly, the enclosure member 30 is pressed toward the leading side by the high pressure fuel acting on the tapered surface 46. Then, the enclosure member 30 is displaced toward the leading side such that the flat surface portion 45 separates from the leading end surface 32*a* (refer to FIG. 4B).

Figure 4B:
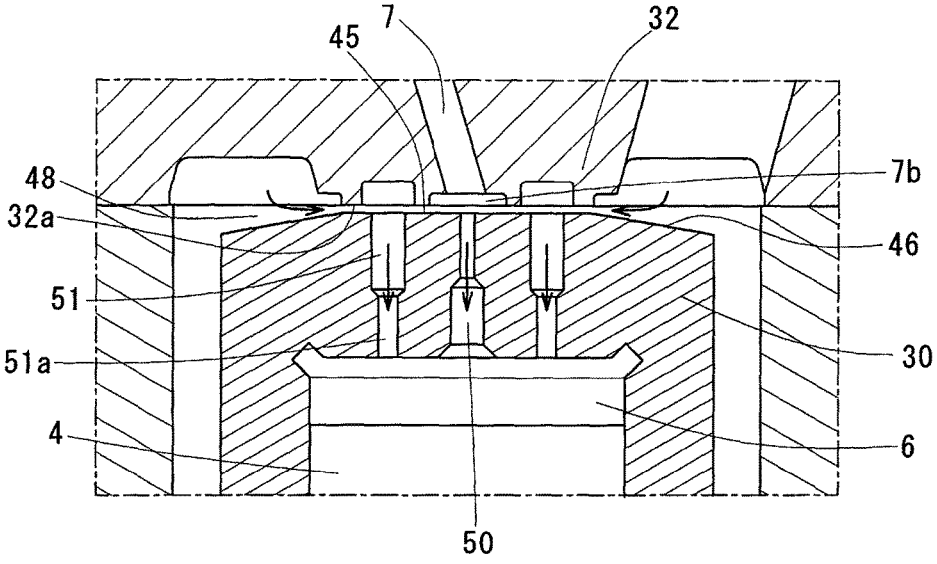
FIG. 4B is an operational view of an enclosure member.

Due to the enclosure member 30 displacing toward the leading side, the gap 48 and the back pressure chamber 6 are in communication through the inflow/outflow hole 50 and the inflow holes 51, and fuel begins to flow into the back pressure chamber 6 (refer to arrows in FIG. 4B).

Due to this, the pressure in the back pressure chamber 6 rises, and the back pressure and biasing force of the spring 31 exceed the force received by the leading end portion of the needle 4. Accordingly, the needle 4 is pushed down toward the leading side and the seat portion 10 is seated on the seat surface 11.

Here, fuel from the gap 48 passes through a space formed between the flat surface portion 45 and the leading end surface 32*a*. Further, the passage cross section area of this formed space is a value from multiplying the displacement amount of the enclosure member 30 by the inner circumference length of the annular flat surface portion 58. The displacement amount of the enclosure member 30 is preferably large enough such that the value of this passage cross section area is sufficiently greater than the total sum of the passage cross section areas of the choke sections 51*a*.

In this case, due to the choke sections 51*a*, it is possible to obtain a configuration where the inflow amount of fuel into the back pressure chamber 6 may be regulated.

(Effects of First Embodiment)

According to the injector 1 of the first embodiment, the enclosure member 30 includes the cover portion 30*a* which covers the rear end of the needle 4 from the rear side, and the cylinder portion 30*b* which is in sliding contact with the outer circumferential surface of the needle 4 and slidably supports the needle 4, thereby forming the back pressure chamber 6 on the rear side of the needle 4. The spring 31 biases the enclosure member 30 toward the rear side. The wall portion 32 is disposed on the rear side of the cover portion 30*a*, and abuts the cover portion 30*a* to regulate movement of the enclosure member 30 toward the rear side. Further, the wall portion 32 includes the opening 7*b* of the outflow passage 7.

Here, the enclosure member 30 includes the inflow/outflow hole 50 and the inflow holes 51 which penetrate through the cover portion 30*a*. Further, the cover portion 30*a* includes the blocking portion 59 which, when the cover portion 30*a* is abutting the wall portion 32, closes the opening 7*b* with respect to spaces outside of the enclosure member 30. Further, the blocking portion 59 is provided so as to surround the openings of the inflow/outflow hole 50 and the inflow holes 51 on the flat surface portion 45, and the inflow/outflow hole 50 abuts the wall portion 32 while being in communication with the outflow passage 7. Further, the spring 31, which is outside of the back pressure chamber 6, biases the enclosure member 30.

Due to this, by filling the gap 48 etc. outside of the enclosure member 30 with high pressure full, the injection hole 9 may be opened and closed by the needle 4.

In other words, when the drive unit 8 opens the outflow passage 7, a fuel flow from the back pressure chamber 6 toward the outflow passage 7 is generated. As a result, the enclosure member 30 is strongly biased toward the rear side by a pressure difference in the fuel flow as well as the biasing force of the spring 31, and the opening 7*b* of the outflow passage 7 is firmly closed by the blocking portion 59. For this reason, while the outside of the enclosure member 30 is blocked from the outflow passage 7 and the back pressure chamber 6, communication between the outflow passage 7 and the back pressure chamber 6 may be maintained. As a result, consumption of high pressure fuel may be suppressed, and as the back pressure reduces, the seat portion 10 of the needle 4 may be separated from the seat surface 11 of the body 5 to open the injection hole 9.

Further, when the drive unit 8 closes the outflow passage 7, the flow of fuel from the back pressure chamber 6 toward the outflow passage 7 is stopped. As a result, the enclosure member 30 is biased by outside fuel pressure, especially fuel pressure acting on the tapered surface portion 46, and temporarily compresses the spring 31 to move toward the leading side. For this reason, the back pressure chamber 6 is temporarily opened with respect to the outside of the enclosure member 30, and high pressure fuel flows into the back pressure chamber 6. As a result, the back pressure is increased, and the seat portion 10 of the needle 4 seats on the seat surface 11 of the body 5 to close the injection hole 9.

As described above, according to the injector 1 of the first embodiment, the enclosure member 30 itself opens and closes a path between outside spaces and the back pressure chamber 6. Thus, consumption of high pressure fuel may be suppressed, and at the same time, the injection hole 9 may be opened and closed by operating the back pressure, i.e., the needle 4. Further, due to the operation of the enclosure member 30 in this manner, the spring 31 may be disposed outside of the back pressure chamber 6 as well.

Accordingly, by disposing the spring 31 outside of the back pressure chamber 6, the capacity of the back pressure chamber 6 may be reduced, and it is possible to mitigate shaking of the needle 4 caused by opening of the injection hole 9.

Further, according to the injector 1 of the first embodiment, the spring 31 is set so as to bias the enclosure member 30 toward the rear side and bias the needle 4 toward the leading side. Thus, the needle 4 is moved toward the leading side by the biasing force of the spring 31 as well as back pressure to close the injection hole 9.

Due to this, the spring 31 may be used as a biasing means for both the needle 4 and the enclosure member 30, and the number of components may be reduced. Further, in the injector 1 of the first embodiment, abrasion resistance treatment is performed on the flat surface portion 45 and the leading end surface 32*a*. Due to this, even when the annular flat surface portions 55, 56 repeatedly abut with the annular flat surface portions 57, 58, abrasion may be suppressed, and therefore reliable use over a long period may be achieved.

(Second Embodiment)

Figure 5:
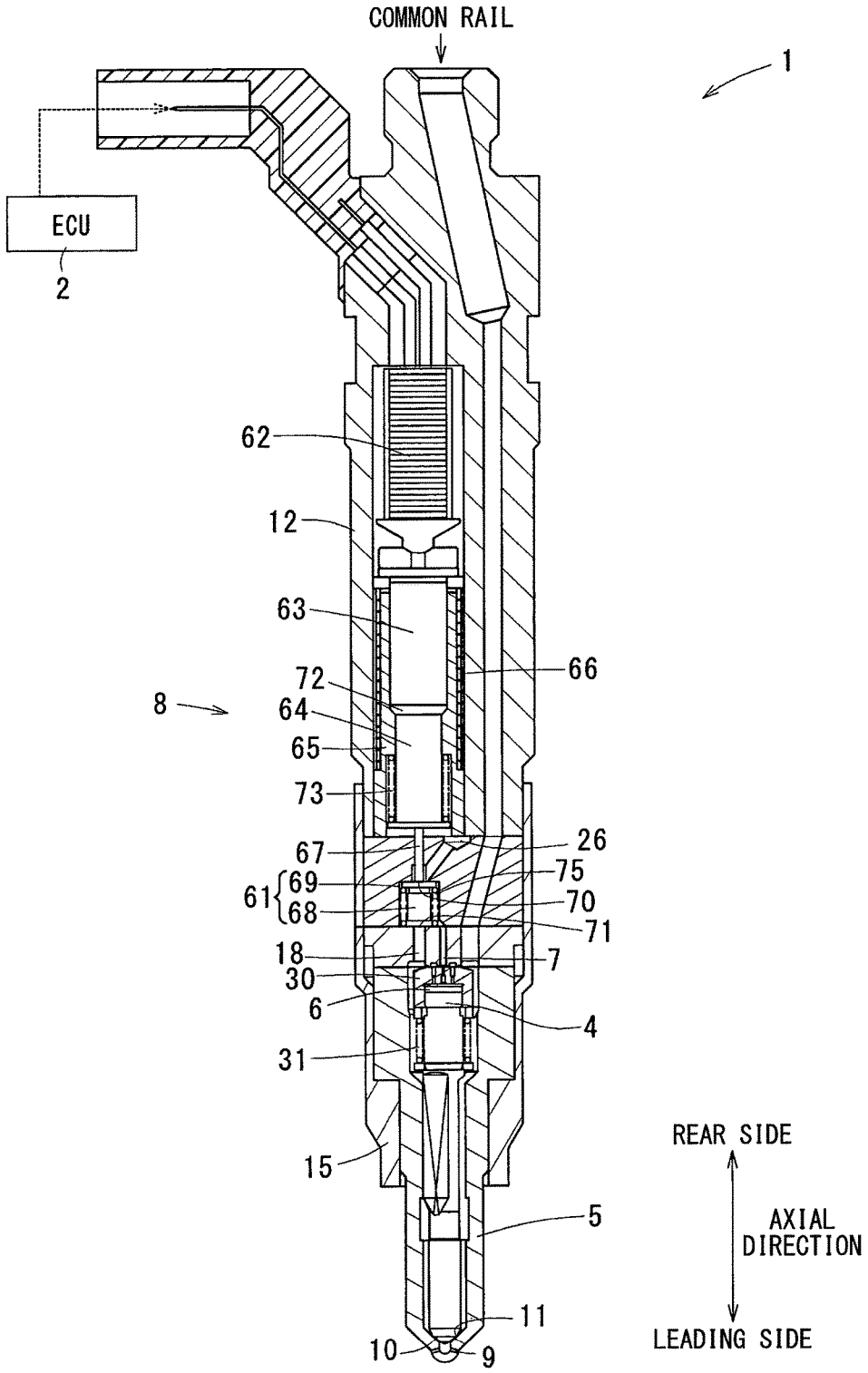
FIG. 5 is a cross section view of an entirety of an injector

A second embodiment will be explained primarily with respect to features which differ from those of the first embodiment, with reference to FIGS. 5 and 6. Further, elements which function similar to those of the first embodiment will be denoted with the same reference numerals in the second embodiment.

A drive unit 8 of the second embodiment increases or decreases the back pressure based on a control signal from the ECU 2 to control the opening and closing of the injection hole 9 via the needle 4. Here, the drive unit 8 includes a three way valve 61 that switches the outflow passage 7 between two connections. Specifically, when the back pressure is to be decreased, the outflow passage 7 is connected to the low pressure passage 26. When the back pressure is to be increased, the outflow passage 7 is connected to the high pressure passage 18.

More specifically, the drive unit 8 may be, for example, a piezo actuator including the three way valve 61, a piezoelement stack 62, a piezo piston 63, a valve piston 64, a cylinder 65, a return spring 66, a valve shaft 67, and a valve body 68.

Further, the valve body 68 forms a part of the three way valve 61. Further, in the second embodiment, while a piezo actuator is used at the drive unit 8, an electromagnetic solenoid may be used instead. The three way valve 61 includes the valve body 68 and a valve chamber 69 which houses the valve body 68. The valve chamber 69 is always in communication with the outflow passage 7. Further, an opening 70 of the low pressure passage 26 opens at a rear end of the valve chamber 69, while an opening 71 of the high pressure passage 18 opens at a leading end of the valve chamber 69.

Here, when a voltage is not applied to the piezoelement stack 62, a valve portion 68*a* of the valve body 68 abuts the rear end surface of the valve chamber 69, thereby closing the opening 70 and opening the opening 71. Due to this, the outflow passage 7 and the high pressure passage 18 are connected to each other through the valve chamber 69 (refer to FIG. 6A).

Conversely, when a voltage is applied to the piezoelement stack 62, the valve body 68 is moved toward the leading side according to an extension of the piezoelement stack 62. As a result, a valve portion 68*b* of the valve body 68 closes the opening 71 and opens the opening 70. Due to this, the outflow passage 7 and the low pressure passage 26 are connected to each other through the valve chamber 69 (refer to FIG. 6B).

Further, in FIG. 6, the arrows represent the flow of fuel.

The piezoelement stack 62 is formed as a stack of a plurality of piezoelectric elements which extend in the axial direction when applied with a voltage. The piezoelement stack 62 extends in the axial direction when applied with a voltage by a signal from the ECU 2.

The piezo piston 63 is a metal cylinder, and is disposed at the leading end side of the piezoelement stack 62. As the piezoelement stack 62 extends and contracts, the piezo piston 63 abuts the piezoelement stack 62 to reciprocate along the axial direction. The valve piston 64 is disposed on the leading end side of the piezo piston 63, and is a metal cylinder that reciprocates in the axial direction along with the reciprocation of the piezo piston 63.

The cylinder 65 slidably supports the piezo piston 63 and the valve piston 64 on a rear end side and a leading end side, respectively. A space 72, which is filled with fuel, is formed between the piezo piston 63 and the valve piston 64. Further, the cylinder 65 is fixed to the retention body 12.

Here, the diameter of the piezo piston 63 is greater than the diameter of the valve piston 64. Accordingly, when the piezo piston 63 is displaced toward the leading side by a displacement amount, the valve piston 64 is displaced toward the leading side by a greater displacement amount. In other words, the extension amount of the piezoelement stack 62 is amplified through the space 72 and transferred to the valve piston 64.

The return spring 66 is disposed between the piezo piston 63 and the cylinder 65, and always biases the piezo piston 63 toward the rear side. Further, the return spring 66 is a metal cylinder having a plurality of slit holes. In addition, a spring 73 is disposed between the valve piston 64 and the cylinder 65, and always biases the valve piston 64 toward the leading side.

The valve shaft 67 is disposed on the leading end side of the valve piston 64. The valve shaft 67 is a metal cylinder that, according to the reciprocation of the valve piston 64, abuts the valve piston 64 and reciprocates in the axial direction.

Further, at the leading end of the valve shaft 67, the valve body 68 is integrally formed with the valve shaft 67. In addition, the valve body 68 is always biased toward the rear side by a spring 75.

In other words, the valve piston 64 is biased by the spring 73 toward the leading side, and the valve shaft 67 is biased by the spring 75 toward the rear side. Accordingly, the valve piston 64 and the valve shaft 67 are securely abutted to each other.

(Operation of Second Embodiment)

Figure 6A:
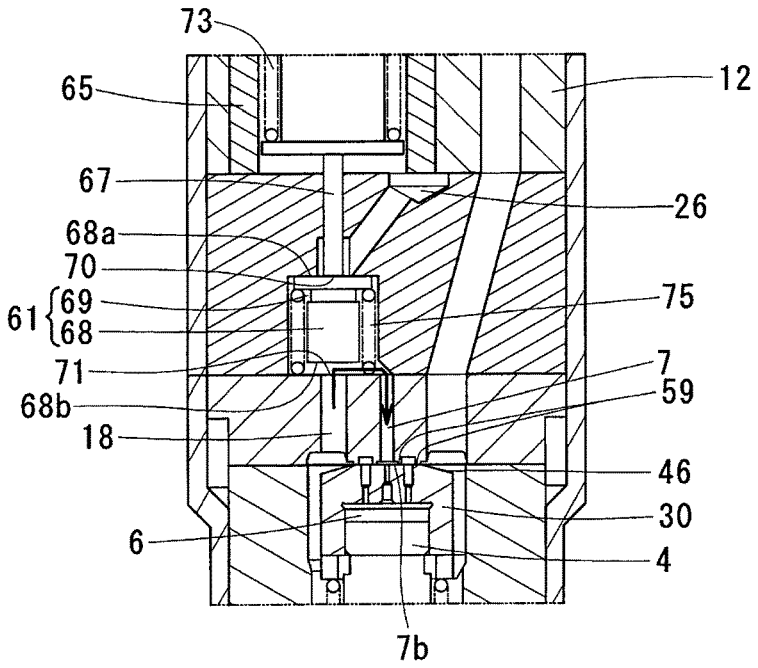
FIG. 6A is a cross section view showing a communication state between a high pressure passage and an outflow passage in a three way valve.
Figure 6B:
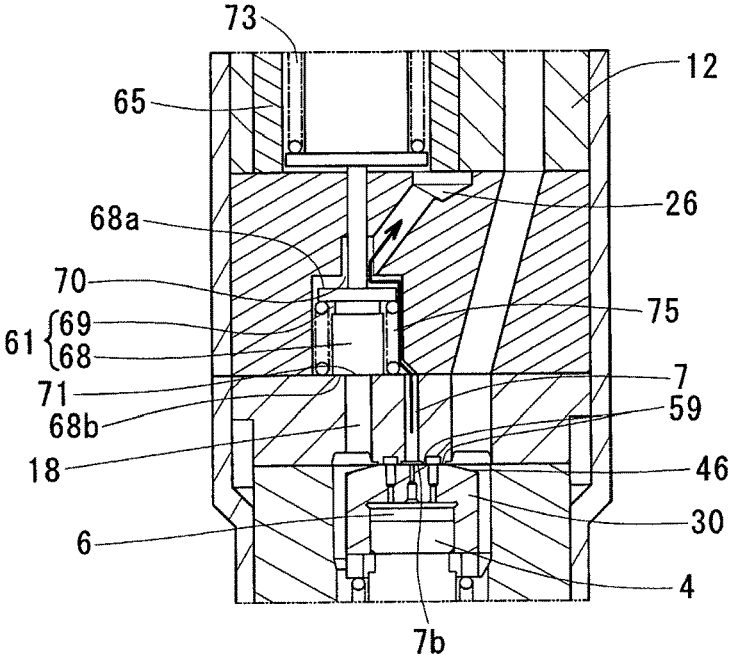
FIG. 6B is a cross section view showing a communication state between a low pressure passage and an outflow passage.

When a voltage is applied to the piezoelement stack 62 based on a control signal from the ECU 2, the valve body 68 opens the outflow passage 7 to the low pressure passage 26 (refer to FIG. 6B). In this case, similar to the first embodiment, the back pressure decreases to operate the needle 4, and the injection hole 9 may be opened.

When the voltage application to the piezoelement stack 62 is stopped based on a control signal from the ECU 2, the valve body 68 communicates the outflow passage 7 with the high pressure passage 18 (refer to FIG. 6A). At this time, the enclosure member 30 is pressed toward the leading side by high pressure fuel applied to the tapered surface 46 as well as by high pressure fuel from the outflow passage 7, and is displaced toward the leading side. Then, similar to the first embodiment, due to the displacement of the enclosure member 30, fuel begins to flow into the back pressure chamber 6, thereby pressing down the needle 4 toward the leading side and closing the injection hole 9.

(Effects of Second Embodiment)

In the injector 1 of the second embodiment, the drive unit 8 increases or decreases the back pressure based on a control signal from the ECU 2 to control the opening and closing of the injection hole 9 via the needle 4. Here, the drive unit 8 includes the three way valve 61 that switches the outflow passage 7 between two connections. Specifically, when the back pressure is to be decreased, the outflow passage 7 is connected to the low pressure passage 26. When the back pressure is to be increased, the outflow passage 7 is connected to the high pressure passage 18.

Due to this, the spaces outside the enclosure member 30 may be filled with high pressure fuel, and at the same time, by switching the connection of the outflow passage 7 between the low pressure passage 26 and the high pressure passage 18, the injection hole 9 may be opened and closed by the needle 9.

In other words, when the drive unit 8 connects the outflow passage 7 to the low pressure passage 26, a fuel flow from the back pressure chamber 6 toward the outflow passage 7 is generated. As a result, the enclosure member 30 is strongly biased toward the rear side by a pressure difference in the fuel flow as well as the biasing force of the spring 31, and the opening 7*b* of the outflow passage 7 is firmly closed by the blocking portion 59. For this reason, while the outside of the enclosure member 30 is blocked from the outflow passage 7 and the back pressure chamber 6, communication between the outflow passage 7 and the back pressure chamber 6 may be maintained. As a result, similar to the first embodiment, consumption of high pressure fuel may be suppressed, and as the back pressure reduces the needle 4 may be separated from the body 5 to open the injection hole 9.

Further, when the drive unit 8 switches the connection of the outflow passage 7 to the high pressure passage 18, the enclosure member 30 is biased by outside fuel pressure acting on itself as well as fuel pressure guided from the high pressure passage 18 into the outflow passage 7, and temporarily compresses the spring to move toward the leading side. For this reason, the back pressure chamber 6 is temporarily opened with respect to the outside of the enclosure member 30, and high pressure fuel flows into the back pressure chamber 6. As a result, the back pressure is increased, and the needle 4 may be seated on the body 5 to close the injection hole 9.

At this time, since the enclosure member 30 is biased by both fuel pressure acting on the outer surfaces of itself as well as fuel pressure guided from the high pressure passage 18 into the outflow passage 7, the enclosure member 30 may be moved toward the leading side faster than in the first embodiment. Accordingly, compared to the first embodiment, the flow of fuel into the back pressure chamber 6 may be started at an earlier timing, and the injection hole 9 may be closed faster.

(Modified Embodiments)

The present disclosure is not limited to the above described points, and a variety of modifications are considered within the gist of the present disclosure.

Further, in the following modified embodiments, elements which are similar to those of the first and second embodiments are denoted with the same reference numerals.

Figure 7A:
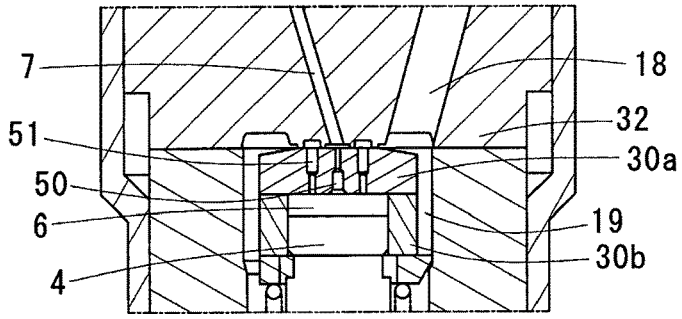
FIG. 7A is a cross section view of a main section of an injector.
Figure 7B:
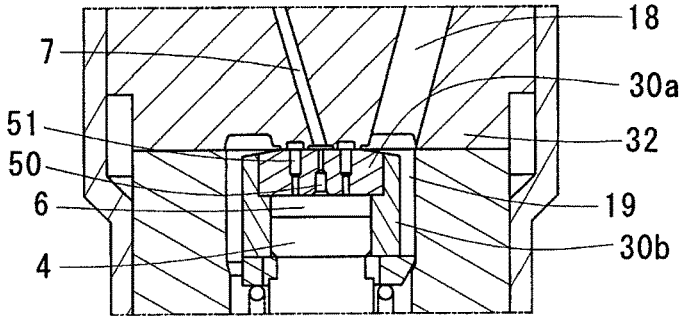
FIG. 7B is a cross section view of a main section of an injector.

In the first embodiment, the enclosure member 30 is formed as a single body, but as shown in FIGS. 7A, 7B, the cover portion 30*a* and the cylinder portion 30*b* may be separately provided. In this case, the enclosure member 30 may be formed by pressure welding the cover portion 30*a* and the cylinder portion 30*b* together.

Due to this, a number of cover portions 30*a* and cylinder portions 30*b* with different shapes may be prepared in advance, and by changing the combination of cover portions 30*a* and cylinder portions 30*b*, a variety of types of enclosure members 30 may be formed. For example, by adjusting the inner diameter of the cylinder portion 30*b*, enclosure members 30 corresponding to needles 4 of different diameters may be formed.

Figure 7C:
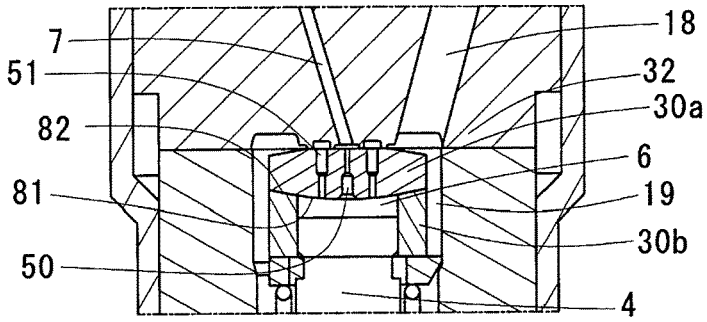
FIG. 7C is a cross section view of a main section of an injector.
Figure 7D:
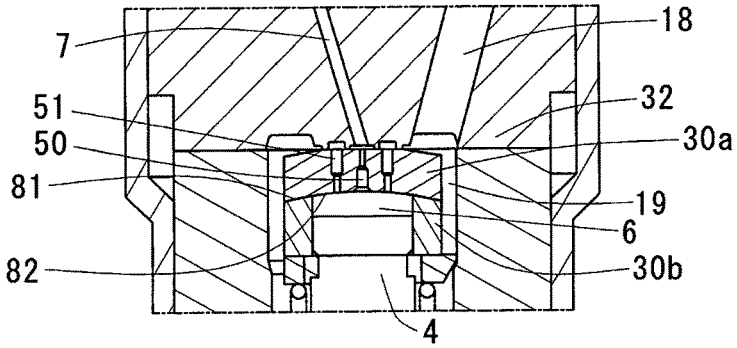
FIG. 7D is a cross section view of a main section of an injector.

Further, when the cover portion 30*a* and the cylinder portion 30*b* are separately provided, the enclosure member 30 may be formed of a protruding sphere portion 81 and a recessed sphere portion 82. Here, the protruding sphere portion 81 and the recessed sphere portion 82 have the same curvature, and the protruding sphere portion 81 is fitted into the recessed sphere portion 82. In other words, as shown in FIG. 7C, the leading end surface of the cover portion 30*a* may be the protruding sphere portion 81, and the rear end surface of the cylinder portion 30*b* may be the recessed sphere portion 82. Further, as shown in FIG. 7D, the leading end surface of the cover portion 30*a* may be the recessed sphere portion 82, and the rear end surface of the cylinder portion 30*b* may be the protruding sphere portion 81.

Due to this, even if the needle 4 is tilted, or if the cylinder portion 30*b* is tilted, this tilt may be suppressed from further transmitting onto the cover portion 30*a*. Accordingly, even if the cylinder portion 30*b* is tilted, the cylinder portion 30*b* simply moves along the protruding sphere portion 81 or the recessed sphere portion 82. For this reason, even if the cylinder portion 30*b* is tilted, the cover portion 30*a* may be suppressed from tilting.

Further, in a case where the cover portion 30*a* and the cylinder portion 30*b* are separately provided and then pressure welded together, there is a concern that high pressure from may flow through a gap between the two and flow into the back pressure chamber 6. However, since high fuel pressure is applied to the cover portion 30*a* and the cylinder portion 30*b* as a compression force in a direction of closing such a gap, the flow of fuel into the back pressure chamber 6 may be suppressed.

In the first embodiment, a configuration is described where the stopper 37 is in direct contact with the enclosure member 30. However, a spacer may be interposed between the stopper 37 and the enclosure member 30 as well. Due to this, a distance between the joint portion 37*a* and the inner wall of the body 5 may be adjusted. Further, a spacer may be provided between the stopper 37 and the spring 31, and may be provided between the stopper 37 and the body 5.

Figure 8A:
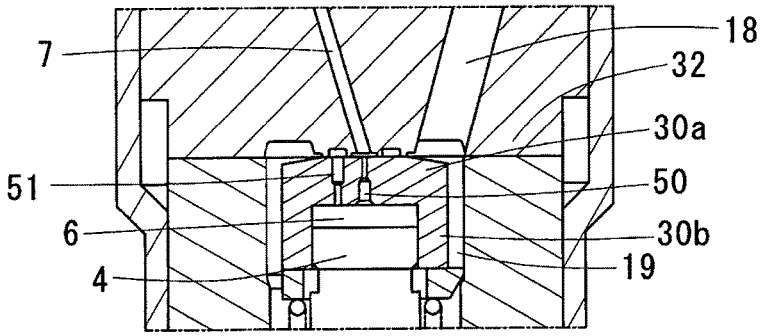
FIG. 8A is a cross section view of a main section of an injector.

In the first embodiment, two inflow holes 51 are formed, but as shown in FIG. 8A, a single inflow hole 51 may be formed instead. Due to this, the process of forming the inflow hole 51 may be simplified.

Figure 8B:
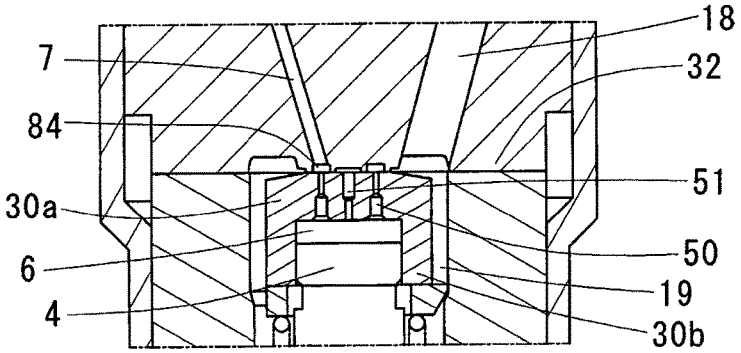
FIG. 8B is a cross section view of a main section of an injector.

In the embodiments, the inflow/outflow hole 50 is formed at a center portion of the cover portion 30*a*, and the inflow holes 51 are formed at peripheral portions. However, as shown in FIG. 8B, the inflow holes 51 may be provided at a center portion, while the inflow/outflow hole 50 may be provided at a peripheral portion instead. Due to this, the outflow passage 7 may be disposed at any position along the annular groove 84, and the placement of the outflow passage 7 may be more flexible. Further, when the cover portion 30*a* is abutting the wall portion 32, the annular groove 84 is an annular groove formed in the wall portion 32 so as to face into the opening of the inflow/outflow hole 50.

Figure 8C:
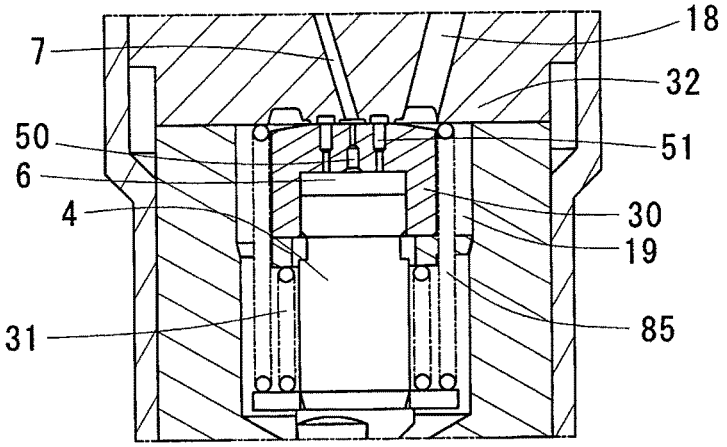
FIG. 8C is a cross section view of a main section of an injector.

In the first embodiment, one spring 31 is provided to bias the needle 4 toward the leading side, but as shown in FIG. 8C, a new spring 85 may be added as well. Due to this, it is possible to increase the combination of the biasing force on the needle 4 toward the leading side and the biasing force on the enclosure member 30 toward the rear side.

The invention claimed is:

1. An injector, comprising:

a needle which is a valve body configured to open and close an injection hole that injects fuel;

a body which has a cylindrical shape and which houses the needle therein, the body having the injection hole;

a back pressure chamber for exerting a back pressure of fuel on the needle in a direction of closing the injection hole;

an outflow passage that allows fuel to flow out of the back pressure chamber;

a drive unit configured to open and close the outflow passage based on a control signal from a controller, thereby increasing or decreasing the back pressure to operate the opening and closing of the injection hole via the needle;

an enclosure member that includes a cover portion configured to cover a rear end of the needle from a rear side, and a cylinder portion configured to be in slidable contact with an outer circumferential surface of the needle to slidably support the needle, the rear end of the needle being surrounded by the cover portion and the cylinder portion to form the back pressure chamber on a rear end side of the needle;

a spring configured to bias the enclosure member toward the rear side; and a wall portion disposed on the rear side of the cover portion and configured to receive an abutment of the cover portion to regulate movement of the enclosure member toward the rear side, the wall portion including an opening of the outflow passage, wherein the enclosure member includes at least one throughhole that penetrates through the cover portion, the cover portion includes a blocking portion that, when the cover portion abuts the wall portion, blocks the opening of the outflow passage with respect to spaces outside of the enclosure member, the blocking portion is provided so as to surround an opening of the throughhole, the throughhole being in communication with the outflow passage even when abutting the cover portion, and the spring is outside of the back pressure chamber to bias the enclosure member.

2. An injector, comprising:

a needle which is a valve body configured to open and close an injection hole that injects fuel;

a body which has a cylindrical shape and which houses the needle therein, the body having the injection hole;

a back pressure chamber for exerting a back pressure of fuel on the needle in a direction of closing the injection hole;

an outflow passage that allows fuel to flow out of the back pressure chamber;

a drive unit configured to increase or decrease the back pressure based on a control signal from a controller to operate the opening and closing of the injection hole via the needle, the drive unit including a three way valve that switches the outflow passage between two connections, the outflow passage being connected to one connection when the back pressure is to be decreased, the outflow passage being connect to another connection when the back pressure is to be increased;

an enclosure member that includes a cover portion configured to cover a rear end of the needle from a rear side, and a cylinder portion configured to be in slidable contact with an outer circumferential surface of the needle to slidably support the needle, the rear end of the needle being surrounded by the cover portion and the cylinder portion to form the back pressure chamber on a rear end side of the needle;

a spring configured to bias the enclosure member toward the rear side; and a wall portion disposed on the rear side of the cover portion and configured to receive an abutment of the cover portion to regulate movement of the enclosure member toward the rear side, the wall portion including an opening of the outflow passage, wherein the enclosure member includes at least one throughhole that penetrates through the cover portion, the cover portion includes a blocking portion that, when the cover portion abuts the wall portion, blocks the opening of the outflow passage with respect to spaces outside of the enclosure member, the blocking portion is provided so as to surround an opening of the throughhole, the throughhole being in communication with the outflow passage even when abutting the cover portion, and the spring is outside of the back pressure chamber to bias the enclosure member.

3. The injector of claim 1, wherein the spring is set so as to bias the enclosure member toward the rear side and also to bias the needle toward a leading side, and the needle is moved toward the leading side by the biasing force of the spring and the back pressure.

4. The injector of claim 1, wherein an abrasion resistance treatment is performed on the blocking portion and the wall portion.

5. The injector of claim 2, wherein the spring is set so as to bias the enclosure member toward the rear side and also to bias the needle toward a leading side, and the needle is moved toward the leading side by the biasing force of the spring and the back pressure.

6. The injector of claim 2, wherein an abrasion resistance treatment is performed on the blocking portion and the wall portion.

* * * * *